US006857244B2

(12) United States Patent
Schmitz

(10) Patent No.: US 6,857,244 B2
(45) Date of Patent: Feb. 22, 2005

(54) CAST STONE FOR FIXING EXTERIOR TRAFFIC SURFACES

(75) Inventor: Michael Schmitz, Rheinmünster (DE)

(73) Assignee: F. Von Langsdorff Licensing Limited, Inglewood (CA)

( * ) Notice: Subject to any disclaimer, the term of this patent is extended or adjusted under 35 U.S.C. 154(b) by 0 days.

(21) Appl. No.: 10/310,916

(22) Filed: Dec. 6, 2002

(65) Prior Publication Data

US 2003/0121229 A1 Jul. 3, 2003

Related U.S. Application Data

(63) Continuation of application No. PCT/EP01/05049, filed on May 4, 2001.

(30) Foreign Application Priority Data

Jun. 7, 2000 (EP) ..... 00112212.6

(51) Int. Cl.[7] ..... E04B 5/04
(52) U.S. Cl. ..... 52/596
(58) Field of Search ..... 59/596, 311.1, 59/603, 604, 605; 404/34, 37, 41, 38, 39, 40; 428/71, 72, 76, 178, 182

(56) References Cited

U.S. PATENT DOCUMENTS

| | | | | | |
|---|---|---|---|---|---|
| 195,286 | A | * | 9/1877 | Ingralls | 404/34 |
| 803,380 | A | | 10/1905 | Wickre | |
| 1,058,674 | A | * | 4/1913 | Kertes | 404/39 |
| 1,884,216 | A | * | 10/1932 | Purdy | 404/39 |
| 2,060,746 | A | * | 11/1936 | Porter | 404/39 |
| 2,114,244 | A | | 4/1938 | Zoettl | |
| 3,903,702 | A | | 9/1975 | Appleton | |
| 4,773,790 | A | | 9/1988 | Hagenah | |
| 5,224,792 | A | * | 7/1993 | Hagenah | 404/39 |
| 5,251,997 | A | | 10/1993 | Brock | |
| 5,342,142 | A | | 8/1994 | Barth et al. | |
| 5,409,325 | A | * | 4/1995 | Wu | 404/34 |
| 5,466,089 | A | * | 11/1995 | Jurik | 404/34 |
| 5,496,129 | A | | 3/1996 | Dubé | |
| 5,503,498 | A | * | 4/1996 | Scheiwiller | 404/34 |
| D389,926 | S | | 1/1998 | Barth et al. | |
| 5,797,698 | A | * | 8/1998 | Barth et al. | 404/39 |
| 5,902,069 | A | | 5/1999 | Barth et al. | |
| 5,921,705 | A | | 7/1999 | Hodson et al. | |
| D425,628 | S | | 5/2000 | Barth et al. | |
| 6,055,784 | A | | 5/2000 | Geiger | |
| D426,317 | S | | 6/2000 | Fifield | |
| 6,508,607 | B1 | | 1/2003 | Smith | |

FOREIGN PATENT DOCUMENTS

| | | | | |
|---|---|---|---|---|
| DE | 295 10 837 U1 | | 10/1995 | |
| DE | 197 33 741 | * | 5/1998 | 404/34 |
| DE | 100 13 613 | * | 10/2001 | 404/34 |
| EP | 1 024 226 A1 | | 12/1998 | |
| EP | 0 930 399 | * | 1/1999 | 404/34 |
| EP | 0 927 792 A2 | | 7/1999 | |
| EP | 1 162 313 | * | 12/2001 | 404/34 |
| WO | WO 95/28523 A1 | | 10/1995 | |
| WO | 00/14335 | * | 3/2000 | 404/34 |
| WO | 01/59217 | * | 8/2001 | 404/34 |
| WO | WO 02/063100 A2 | | 8/2002 | |

* cited by examiner

*Primary Examiner*—Jose V. Chen
(74) *Attorney, Agent, or Firm*—Cahn & Samuels, LLP

(57) ABSTRACT

There has been disclosed a cast stone (1) for securing traffic areas outdoors, with the stone (1) bearing at least one pair consisting of a protrusion (9) and an adjacent recess (10) substantially matching the form of the protrusion of the adjoining laid stone (1). It is provided that the tip of the protrusion (9) and the bottom (13) of the recess (10) have an integrally moulded layer (12) of material facing away from the associated lateral face (3, 4).

8 Claims, 1 Drawing Sheet

CAST STONE FOR FIXING EXTERIOR TRAFFIC SURFACES

This application is a continuation of PCT application number PCT/EP01/05049, filed on May 4, 2001, which claims priority from European application number 00112212.6, filed on Jun. 7, 2000.

BACKGROUND OF THE INVENTION

1. Field of the Invention

The invention relates to a cast stone for securing outdoor traffic areas.

2. Description of the Prior Art

The invention relates to a cast stone made particularly from concrete, for securing traffic areas outdoors, with the stone having at least one pair formed by a protrusion and an adjacent recess substantially matching the form of the protrusion of the adjoining laid stone on its lateral faces extending vertical to the plane of laying and in substantially mutually parallel relationship and with the sequence of protrusion and recess having the same form on all lateral faces in the circumferential direction of the cast stone.

Such cast stones, which are to include plates, particularly plates of concrete, can be optionally provided with a textured surface over their entire area. Since the sequence of protrusion and recess is the same in the circumferential direction of all cast stones, no special attention is required for the laying work. In the way in which they get into the hands of the worker, the cast stones can be set against previously laid stones. The mutual interlocking of the stones obtained with the aforementioned means furthermore results in a bonding which is effective in both directions parallel to the associated lateral faces, whereby there is obtained a cover which in regard to strength parallel to the plane of laying sustains all usually developing load conditions.

In regard to the joint of adjacent stones there exists the regulation that such a joint must have a minimum width of about 2 to 5 millimetres to conform to the respective national regulation so that thermal expansions are absorbed and production tolerances of the cover made from the stones are accommodated and that the filler material of the joints, usually sand, commonly washed in after laying the stones, fills the joints without cavities remaining. When the stones are laid by hand, such a form of joints can be provided by the operator by ensuring that the spacing of adjoining stones or the development of the joint according to regulations are obtained, for instance by extending strings along which the stones are aligned during the laying work.

But the related work is time consuming and requires the employment of trained persons. When the stones are to be laid by a machine making use of appropriate mechanical means—for which purpose the stones are combined into a larger number of structure units containing stones in mutually bonded relationship—the development of the joints according to regulations is not possible. As a matter of fact, when such structure units are set down for laying, the stones get spaced, in the average, by about one millimetre. The resulting joint does not correspond to the nominal width of 3 to 5 millimetres specified by the standards.

In order to overcome the above-described problems, it has been known for cast stones with flat lateral faces, to provide these lateral faces with an increased number of cog-like protrusions, with the protrusions having in the direction perpendicular to the associated lateral face a height such that in an unguided setdown, the required width of the joint is obtained, and this even when the stones are set down by machines in the above-described form of so-called structure units. These protrusions, which are usually required in larger numbers, necessitate an accordingly expensive form of the moulds for producing the cast stones and, in corresponding numbers, they still form spots at which the filler material for the joints is prevented from penetrating into the joints so that cavities into which the filler later sags, cannot be avoided.

It is therefore the problem underlying the invention to indicate for cast stones of the above-specified type a possibility of ensuring the prescribed joint spacing with a minimum number of these spacer elements, wherein particularly crucial measures to be satisfied by the tools used for moulding the stones are avoided.

SUMMARY OF THE INVENTION

Thus, in one embodiment, the present invention provides a cast stone, made particularly from concrete, for securing traffic areas outdoors, with the stone having at least one pair formed by a protrusion and an adjacent recess substantially matching the form of the protrusion of the adjoining laid stone on its lateral faces extending vertical to the plane of laying and in substantially mutually parallel relationship and with the sequence of protrusion and recess having the same form on all lateral faces in the circumferential direction of the cast stone, characterized in that the tip of the protrusion and the bottom of the recess are provided with an integral, moulded layer of material facing away from the associated lateral face.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 2:
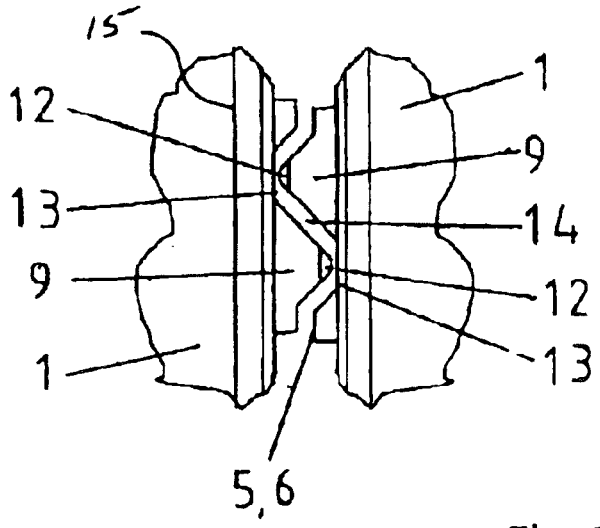
FIG. 2 illustrates the section II of FIG. 1 on an enlarged scale.

As indicated above, the problem addressed by the present invention is to ensure that the prescribed joint spacing is provided for cast stones of the above-specified type with a minimum number of spacer elements, while avoiding the need for specialized tools etc.

Based on a cast stone of the above-specified type, this problem is solved in accordance with the invention in that the tip of the protrusion and the bottom of the recess are provided with an integral, moulded layer of material facing away from the associated lateral face.

This inventive measure limits the arrangement of protrusions providing for a joint gap according to regulations to the smallest possible number, namely the mutual interlocking of adjacent stones, with the interlocking determining their spacing. In this way the lateral faces of the stones are completely free of any parts impeding the penetration of the filler material into the joints so that a relatively easy, reliable filling of the joints is ensured.

On the other hand, no particular requirements are to be met by the moulds used for producing the stones because the form of the respective protrusion or the respective recess must be introduced or prepared in any event, so that there are practically no expenses to create, at the tip of the protrusion or at the bottom of the recess, space for the layer of material by which broadening is obtained at the tip of the protrusion and a flattened area at the bottom of the recess with a ledge-like extension over the entire height of the cast stone.

Since the joint between adjacent stones has to have a certain minimum width in dependence upon state regulations, it is convenient and sufficient to give the layer a depth in the range of 0.5 to 4 millimetres perpendicular to the associated lateral face of the stone; the smaller depth suffice when the stones are laid with machines in the above-described manner because, as indicated above, an additional spacing of 1 to 1.5 millimetres automatically results on this occasion.

So far there have been considered cast stones which abut each other except for the cited gap; the shaping is such that the protrusions extend from the lateral faces of the stones, whereas the recesses are situated within the mass of the stone behind the plane defined by the lateral faces, and both the protrusion and the recesses naturally extend over the entire height of the lateral faces of the stones.

However, there are instances which require that the cast stones have a significantly greater spacing than the cited 2 to 5 millimetres, with the development of broad joints, so that surface water can seep of via such broad joints, and/or that there is given an option for a particular design of the area covered with stones, for example by putting in seeds for a lawn. This includes the so-called lawn-grid stones or lawn-grip plates with additional perforations of the stone or plate surface, wherein the perforation can be filled with soil and provided with grass seed.

In order to design also such stones within the scope of the invention, it is convenient to configure the cast stone for the development of wide joints with at least one integral moulded spacer cog between adjacent stones on at least one lateral face and to have the exposed tip of the spacer cog bear the pair formed by the protrusion and the recess. There does not exist the problem of thermal expansion resulting for the wide joint formed by the spacer cogs, of the production tolerances, and the introduction of filler material between the cast stones, however there exists the problem of the longitudinal extension of the interlocking provided by the exposed ends of the spacer cogs, which interlocking is required, on the one hand, for bonding of the stones to sustain all eventual loads and, on the other hand, has in its extension defined by the width of the cogs a length such that also their filling with the filler material is required. Otherwise, between the cogs there might remain cavities the filling of which from the side of the cogs is not ensured.

Since in the above-described cases there can exist great difference in the filler material's suitability for discharge by pouring, the layer on the tip of the protrusion or the bottom of the recess can be given a larger size, e.g., in the range of about 5 millimetres.

Furthermore, it is convenient that the effective length of the stone's various side faces parallel to the plane of laying of a stone is the single or integer multiple of a smallest effective length and that each of the side face section having the smallest effective length is provided with a pair composed of protrusion and recess or a spacer cog bearing the same. This dimensioning takes into account that in the case of sets of stones for a laid pattern, the size of the cast stones normally results from a single smallest basic dimension or a multiple thereof. With this smallest basic dimension, the effective lateral length is to be assumed as the proper lateral length of the stone plus twice half of the joint adjoining the side in its longitudinal extension three times the length of the basic dimension, the central length section of this stone corresponds in this longitudinal extension to the effective length of the basic dimension, whereas that side's length sections following on both sides correspond to a length section of the stone plus half the width of the joint adjoining in this longitudinal direction.

It is in this connection advantageous that the center axis of this pair composed of protrusion and recess or spacer cog is situated on the middle of the associated lateral face section.

Furthermore, it is convenient that the flanks of the protrusion, on the one hand, and of the recess, on the other, include an angle of at least 90° and that the bisector of this angle is arranged perpendicular to the associated side face of the stone. This ensures that, on the one hand, the stones have good mutual bonding and, on the other hand, that it is possible in each case to insert stones via a substantially horizontal shifting also into the corner of the angle formed by a previously laid adjacent stone.

Finally, it may be advantageously provided that the horizontal cross section contour of the layer of material extends smoothly into the flanks of the protrusion and of the recess.

Figure 1:
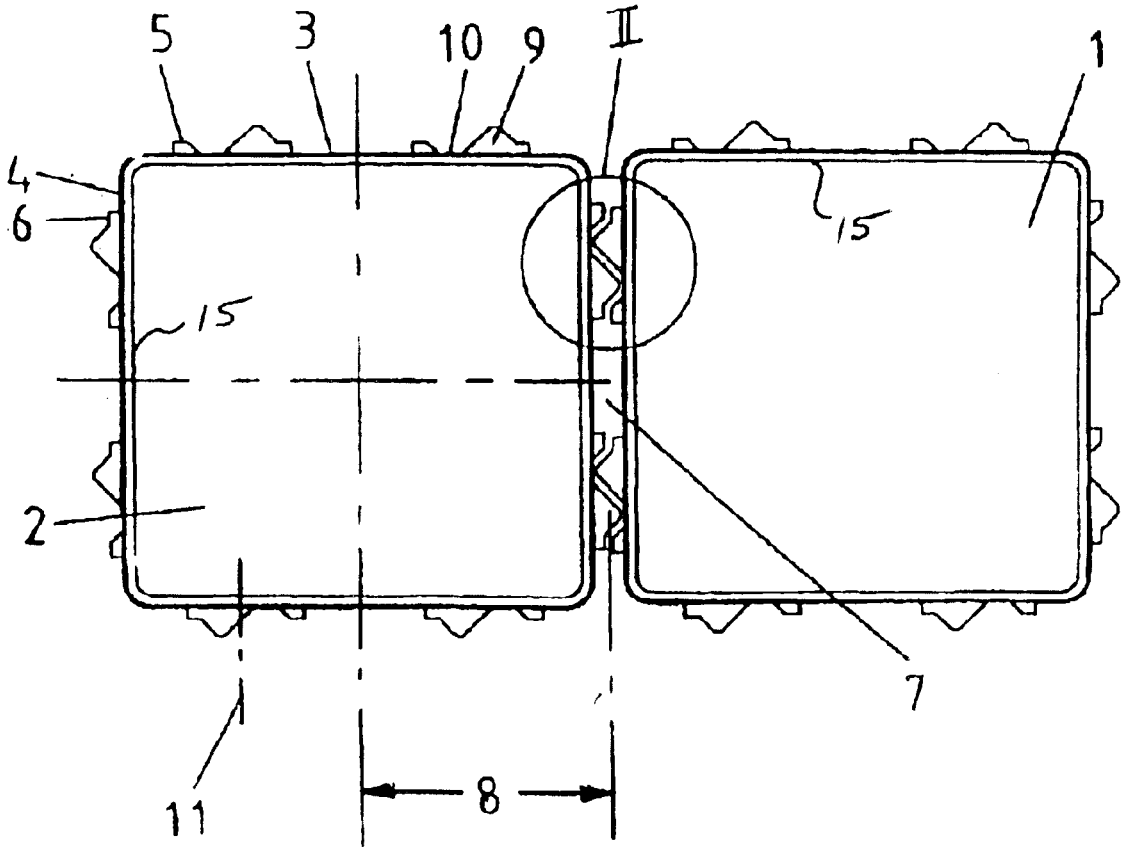
FIG. 1 illustrates two cast stones laid to abut each other.

FIG. 1 shows two square stones which, in accordance with the center lines indicated on one stone, are composed of the quadruple of a basic square surface 2. The lateral faces 3, 4 of each of the basic surfaces 2 bear a spacer cog 5, 6. The presence of these spacer cogs means that the effective length of each of the basic surfaces 2 is in the present case given by the side length 3, respectively 4, plus half the width of the gap 7 between the two cast stones indicated, i.e., the area denoted by the numeral 8.

The end faces of the cogs 5, 6 have a protrusion 9 and a recess 10 in side-by-side relationship; when viewed in the circumferential direction of the cast stone 1, the protrusions 9 and the recesses 10 of all spacer cogs 5, 6 follow each other in the same sequential order. In this way, the facing end faces of the spacer cogs of adjacent stones fit into each other in form-locking fashion.

The spacer cogs 5, 6 have the same position relative to all effective lengths 8 in a way such that the center axes 11 of all the spacer cogs meet at the middle of the effective length 8.

The flanks of both the protrusions 9 and the recesses 10 include a matching angle having a size of at least 90°, but preferably of 90°, with the bisector extending perpendicular to the associated part of the lateral faces 3, 4.

As can be recognised particularly in FIG. 2, the protrusions 9 bear an added layer 12 which is integrally formed at their tip and starts from a profile exactly matching the recesses 10 and extends over the entire height of the stone, with the contact of the layer at the bottom 13 of the associated recess 10 ensuring that the form of the flanks of interlocking protrusion/recess pairs maintains a spacing which allows unobstructed, complete filling of the joint defined by this spacing with filler material so that no cavities can develop, or can remain, between the cogs. The horizontal cross section of the layer 12 is chosen so that there is a gapless i.e. smooth transition into the flanks of the protrusion.

On the cast stones 1 there are provided cogs 5, 6 to form wide joints 7 and, hence, a cover allowing inter alia, the draining of surface water via the joints 7. The protrusions 9 extend beyond the front edge of the cogs 5, 6 whereas the recesses 10 are located toward the rear in the material of the cogs.

If the afore-described interlocking is to be used with directly laid stones i.e. stones laid without intermediate cogs, their form can be visualised with the aid of FIG. 1, namely that in that case, the recesses 10 start from the lateral faces 3, 4 and are situated in the bulk of the stones 1, whereas only the protrusions 9 extend outwards from the lateral faces 3, 4. In this way, between the lateral faces 3, 4 of adjacent stones, i.e. along the entire circumference of the respective stone 1, there results a joint having the size of the joint 14 merely by the effect of the layer 12 without need for other measures causing spacing.

It is noted for the sake of good order that the protrusions 9 and the recesses each extend over the full height of the spacer cogs 5, 6 or, in the case of the last-described stones over the entire height of the lateral faces 3, 4 because otherwise the gap 14 of the joint could not be reached by the filler material. As to the line 15 which is spaced inwards from the lateral faces 3, 4, it denotes a chamfer by which the edge of the cast stones 1 is inflected at this point.

Instead of forming an adequate joint 14 by the layer 12 of material, the same effect can be obtained when, while omitting the layer 12, the bottom 13 of the recesses 10 is given further flattening by a layer, in addition to the flat form illustrated, with the size of the flattening perpendicular to the associated lateral faces 3, 4 corresponding to the extent of the layer 12 of material.

Although the invention has been described with reference to certain specific embodiments, various modifications thereof will be apparent to those skilled in the art without departing from the spirit and scope of the invention as outlined in the claims appended hereto.

What is claimed is:

1. A cast stone, made particularly from concrete, for securing traffic areas outdoors, with the stone having at least one pair consisting of a protrusion and an adjacent recess substantially matching the form of the protrusion of an adjoining laid stone on its lateral faces extending generally vertically and in substantially mutually parallel relationship, said protrusions and recesses being alternately provided on all lateral faces along the perimeter of the cast stone, characterized in that at least one of said protrusions or said recesses are provided with an integral, moulded layer of material facing away from the respective lateral faces of the stone.

2. The cast stone according to claim 1, characterised in that perpendicular to each lateral face, the layer of material has a depth in the range of 0.5 to 4 millimetres.

3. The cast stone according to claim 1, characterized in that, for developing wide joints between adjacent stones, the stone is provided on at least one of the lateral faces with at least one integral, moulded spacer cog and wherein the spacer cog bears the pair formed by the protrusion and the recess.

4. The cast stone according to claim 3, characterized in that in the case of a plurality of spacer cogs of a stone, each of said cops has an identical shape.

5. The cast stone according to claim 1, characterized in that the length of the lateral faces is the single or integer multiple of a smallest length and that each of the section of the lateral faces of smallest length is provided with a pair formed by a protrusion and a recess or a spacer cog bearing a pair formed by a protrusion and a recess.

6. The cast stone according to claim 5, characterised in that a center axis of all pairs formed by protrusion and recess or spacer cogs is situated on the middle of the length of the respective lateral faces.

7. The cast stone according to claim 1, wherein said protrusions and recesses have flanks and characterized in that the flanks of the protrusions and the recesses include an angle of at least 90° and that the bisector of such angle is perpendicular to the respective lateral face of the stone.

8. The cast stone according to claim 1, wherein said protrusions and recesses have flanks and characterized in that a horizontal cross section contour of the layer of material extends smoothly into the flanks of the protrusion and of the recess.

* * * * *